US005391129A

United States Patent [19]

Zaitsev

[11] Patent Number: 5,391,129

[45] Date of Patent: Feb. 21, 1995

[54] SWIMMER TRAINING DEVICE

[75] Inventor: Viatcheslav K. Zaitsev, Moskau, Russian Federation

[73] Assignee: Promotech Corporation, Liechtenstein, Germany

[21] Appl. No.: 193,070

[22] PCT Filed: Jun. 2, 1993

[86] PCT No.: PCT/EP93/01379

§ 371 Date: Apr. 7, 1994

§ 102(e) Date: Apr. 7, 1994

[87] PCT Pub. No.: WO93/24190

PCT Pub. Date: Dec. 9, 1993

[30] Foreign Application Priority Data

Jun. 4, 1992 [DE] Germany ..... 4218478

[51] Int. Cl.[6] ..... A63B 69/10

[52] U.S. Cl. ..... 482/56; 482/37; 482/54; 482/142

[58] Field of Search ..... 482/56, 55, 142, 54, 482/37; 434/254

[56] References Cited

U.S. PATENT DOCUMENTS 4,162,788 7/1979 Turnier ..... 482/56
5,158,513 10/1992 Reeves ..... 482/56
5,269,736 12/1993 Roberts ..... 422/56

FOREIGN PATENT DOCUMENTS 0499879 1/1976 U.S.S.R. ..... 482/55
1077614 3/1984 U.S.S.R. ..... 482/56
1395343 5/1988 U.S.S.R. ..... 482/56

*Primary Examiner*—Richard J. Apley
*Assistant Examiner*—Lynne A. Reichard
*Attorney, Agent, or Firm*—Griffin, Butler, Whisenhunt & Kurtossy

[57] ABSTRACT

A muscle training device which is particularly suitable for swimmers has a user supporting surface (2). Two traction elements each of which turns about two pivots (9, 10) are arranged in front of the user supporting surface (2). The traction elements are provided with gripping elements (7). A biasing device (4) opposes a force applied to move each traction element. In order to ensure effective muscle training, both traction elements (6) are symmetrically arranged at an angle α with respect to a longitudinal axis of the user supporting surface (2). The spacing between the traction elements (6) at their pivots (9) nearest to the user supporting surface (2 ) is greater than the spacing between the pivots (10) farthest from the user supporting surface (2). The top span of the traction element (6) has a curved surface (8) shaped as a path described by hands during swimming. The pivots (9) nearest to the user supporting surface (2) lie lower than the pivots (10) farthest from the user supporting surface (2).

8 Claims, 3 Drawing Sheets

SWIMMER TRAINING DEVICE

BACKGROUND OF THE INVENTION

The invention concerns a device for muscle training, particularly for swimmers, according to an introductory portion of claim 1.

From SU-A 597 376 a generic device for exercising muscles for swimmers is known which is used for imitating a swimming movement, particularly a movement for the crawl stroke. This known device employs a traction element that is arranged along a length axis of a swimmer supporting surface. The traction element is quite wide so that arms of the swimmer can alternately interact with gripping elements of the traction element. Accordingly, space requirements for this known device are substantially great.

SUMMARY OF THE INVENTION

A top span of the traction element is particularly constructed to be straight and extends at an angle to a length axis of the supporting surface. This does not correspond to a movement path of an arm when a swimmer is doing the crawl stroke or the butterfly stroke so that muscles are not strained in the same manner as when they do the corresponding swimming movements. The effectiveness, therefore, of existing muscle exercising devices is small.

It is an object of this invention to provide a device for training muscles, particularly those of a swimmer, with an uncomplicated structure which makes possible effective muscle training.

This object is achieved by combining the generic state of the art with the characterizing limitations of claim 1. Beneficial further embodiments of the inventive device are recited in patent claims 2 through 8.

The inventive embodiments of the device make it possible for a user to carry out swimming movements for a corresponding swimming style. It is therefore possible to target particular muscle groups which are necessary for corresponding swimming movements. Therefore, effective training is possible with the device of this invention.

If gripping elements are made as is recited in claim 2, they can be gripped easily with hands. Also, injury to a swimmer is avoided.

If a curved radius of a bow-shaped upper surface can be changed as recited in claim 3, the device can be adapted for anthropometric data of a swimmer.

A mattress filled with a fluid in accordance with claim 6 makes it possible for a body to imitate its movements which take place during swimming in water.

BRIEF DESCRIPTION OF THE DRAWINGS

An embodiment of the invention is described in more detail below with use of the drawings; wherein.

DETAILED DESCRIPTION OF THE INVENTION

Figure 1:
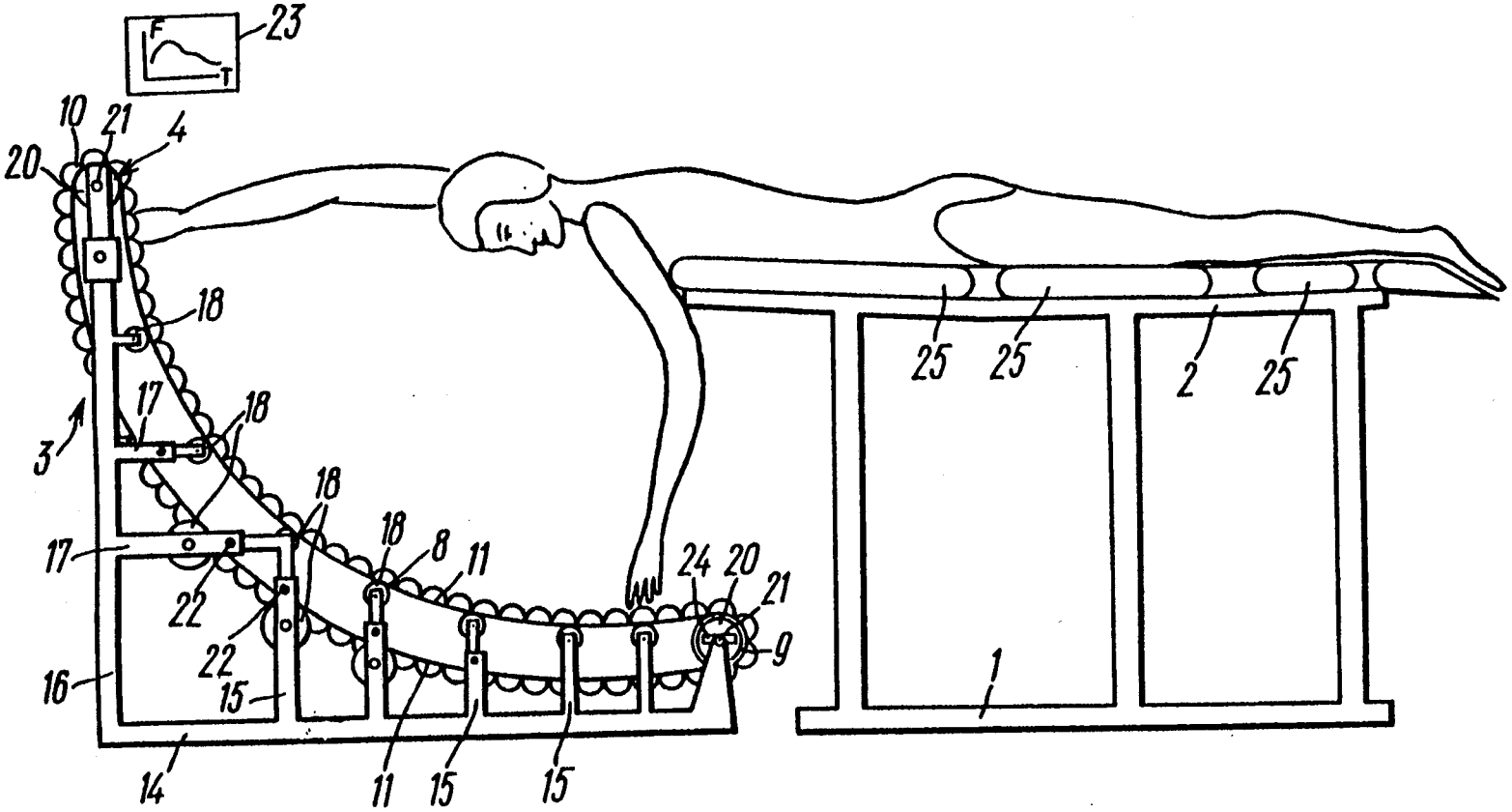
FIG. 1 is a side view of a muscle training device.
Figure 2:
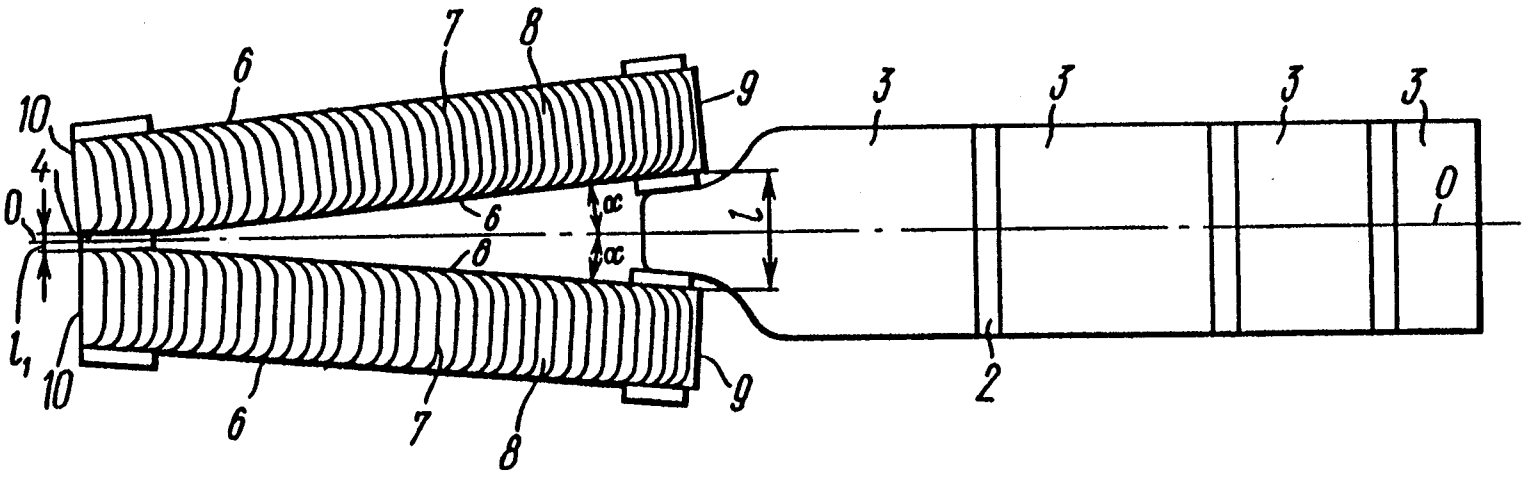
FIG. 2 is a top view of the device of FIG. 1.

The device shown in FIG. 1 serves to train muscles which are used during swimming movements.

The device has a frame 1 on which a surface 2 for supporting a user is arranged. The device further has a force unit 3 and a loading device 4.

The force unit 3 includes two identical endless traction elements 6 which extend about two pivots 9, 10 in the manner of a conveyor belt. The endless traction elements 6 are provided with gripping elements 7 for hands of a user. Each endless traction element 6 is so constructed that the user engages a gripping element 7 when carrying out a swimming movement and pulling his arms through against a force. The loading device 4 serves as a brake for the traction element 6 so as to provide a resistance to pulling the traction element through.

The traction elements 6 are, relative to a longitudinal axis O—O of the user supporting surface 2, geometrically arranged. The upper spans of the traction elements 6 have bowed-shaped upper surfaces 8 (FIG. 1) which correspond to actual movement paths of hands of a swimmer when carrying out a swimming movement. The traction elements 6 are arranged at an acute angle $\alpha$ relative to the longitudinal axis O—O of the user supporting surface 2. The pivots 9 of the traction elements 6 nearest to the user supporting surface 2 lie below the supporting surface 2. A spacing 1 between the pivots 9 of the traction element 6 closest to the supporting surface 2 is larger than the spacing $1_1$ between the pivots 10 of the traction elements 6 furthest from the supporting surface 2, which are located in front of the supporting surface 2.

Figure 3:
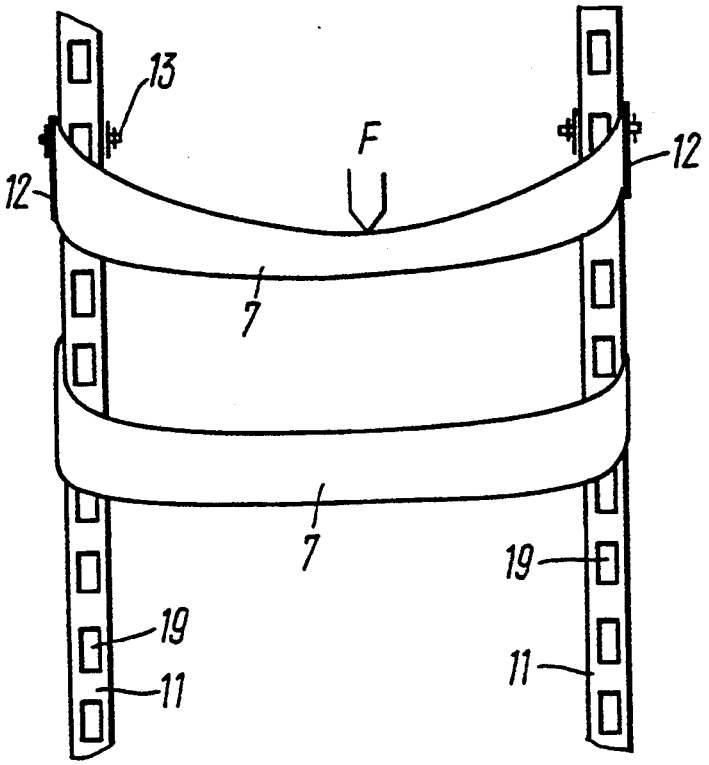
FIG. 3 is a portion of an endless traction element.
Figure 4:
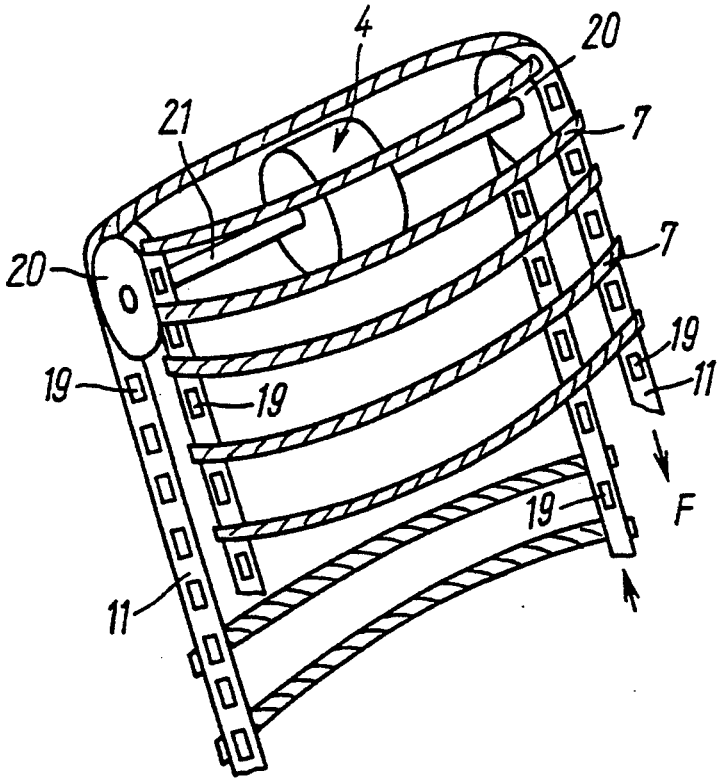
FIG. 4 shows interaction of an endless traction element with a loading device.

Each endless traction element 6 comprises two endless parallel extending bands 11 (FIGS. 3, 4) or chains, to which gripping elements 7 for hands of a user are perpendicularly attached. The gripping elements 7 have the shape of strips and are of flexible material, for example of web material or leather. The strips are bowed-shaped and are affixed to the bands 11 by means of plates 12 and attaching elements 13 (FIG. 3).

To form the bowed-shaped upper surfaces 8 (FIG. 1) each endless traction element 6 is mounted on a frame 14 at vertical supports 15 and. 16. The heights of the vertical supports are gradually reduced corresponding to a curve of the upper surface 8 in a direction towards the frame 1 and finally possibly increased a little bit behind a shoulder joint of the user. Horizontal struts 17 are attached at one end to the vertical support 16 which is furthest from the user. The lengths of the struts 17 increase downwardly to form the gradual bowed shape of the upper surface 8 toward the supports 15. Rollers 18 are mounted at ends of the supports 15 and struts 17 for supporting the upper and lower spans of the endless bands 11. The endless bands 11 have openings 19 (FIG. 4) with which they engage teeth on gears 20 which are mounted on shafts 21 when the endless traction elements 6 are pulled through.

Each support 15 (FIG. 1) and each strut 17 comprises two telescoping parts. By this means, the parts can be moved relative to one another to make possible a corresponding change in a curved radius of the bowed-shaped upper surface 8 of the upper span of the traction element 6. This allows effective training of swimmers with various anthropometric data to be carried out. The parts can be affixed for each support 15 and each strut 17 by means of an attaching element 22. The loading devices 4 which cooperate with the endless traction elements 6, can be, as desired, known electromagnetic apparatus, such as electromagnets, or motor generators, as well as friction couplings. The loading device 4 is coupled to a load indicator 23 by the shaft 21 of the gears 20 of the pivot 10 farthest from the supporting surface 2. It produces a resistance against the pulling through of the endless traction element 6, that is, simultaneously for both traction elements or particularly for each.

The shafts 21 of the gears 20 of the pivot 9 closest to the user supporting surface 2 of the traction elements 6 are mounted on the frame 14 by means of a tensioning apparatus 24. With the tensioning apparatus 24, the tension of the upper and the lower spans of the traction elements 6 can be adjusted. A mattress 25 is arranged on the supporting surface 2 of an apparatus for imitating the floating of a body of a swimmer. The mattress 25 is filled with a fluid, such as air or water.

When training is carried out a user lies comfortably on the mattress 25. Thereafter, he begins to carry out swimming movements with his arms, which movements correspond to those of a crawl stroke or a butterfly stroke.

When the crawl stroke is carried out, each arm of the swimmer is moved through a path which is close to a circular path. At a moment in which a hand normally enters water, it engages a corresponding gripping element 7 of the appropriate endless traction element 6 and pulls it, upon further movement, through, whereby the traction element 6 runs on the rollers 18 mounted on the supports 15 and the struts 17. The endless bands 11 of the traction elements 6, by means of their openings 19, rotate the gears 20 which, in turn, transmit a rotational moment to the loading device 4. If the loading device is an electronic apparatus, it creates an electromagnetic flow dependent upon the pulling-through speed, i.e., the rotational speed of the gears 20, which applies a counter-resistance to a exercising force of the user pulling the traction element 6 through. This is displayed on the load indicator 23 for training parameters being carried out, for example as a force-time line (F-T function).

When carrying out a butterfly stroke, both user's arms simultaneously pull against the traction elements 6 and carry this motion through.

I claim

1. A muscle training device, particularly for swimmers:

having a user supporting surface (2);

having an endless traction element (6) which turns about two pivots (9, 10) arranged in front of the user supporting surface (2), said traction elements being provided with gripping elements (7) and a loading device (4) for applying a force opposing movement of the traction element (6);

characterized in that:

a further endless traction element (6) is provided;

both traction elements (6) being symmetrically arranged at an angle e with respect to a longitudinal axis of the user supporting surface (2), whereby a spacing between the traction elements (6) at their pivots (9) nearest to the user supporting surface (2) is greater than a spacing between their pivots (10) farthest from the user supporting surface (2); and upper strands of the traction elements have curved upper surfaces (8), whereby the pivots (9) nearest the user supporting surface (2) lie lower than the pivots (10) farthest from the user supporting surface.

2. A muscle training device as in claim 1 wherein the traction elements (6) are each comprised of two endless bands (11) and the gripping elements (7) are formed as flexible and bowed-shaped strips which are attached to the bands (11) to be perpendicular thereto.

3. A device as in claim i wherein curves of the upper surfaces (8) can be changed.

4. A device as in claim 1 wherein the loading device (4) is an electromagnetic apparatus.

5. A device as in claim 1 wherein the loading device (4) is a friction coupling.

6. A device as in claim 1 wherein a fluid-filled mattress (25) is arranged on the supporting surface (2).

7. A device as in claim 1 wherein the curved upper surfaces (8) adapted to conform to movement of the user's hands during a crawl stroke.

8. A device as in claim 1 wherein the curved upper surfaces (8) adapted to conform to movement of the user's hands during a butterfly stroke.

* * * * *